United States Patent [19]

Perkin et al.

[11] 4,023,630

[45] May 17, 1977

[54] WELL JAR HAVING A TIME DELAY SECTION

[75] Inventors: Gregg S. Perkin, Redondo Beach; Glen Robinson, Oakview; Theodore G. Thometz, Long Beach, all of Calif.

[73] Assignee: Smith International, Inc., Irvine, Calif.

[22] Filed: Jan. 14, 1976

[21] Appl. No.: 649,037

[52] U.S. Cl. ..... 175/297; 175/304

[51] Int. Cl.[2] ..... E21B 1/10

[58] Field of Search ..... 175/296, 297, 300, 304; 92/181 R, 183

[56] References Cited

UNITED STATES PATENTS

| | | | |
|---|---|---|---|
| 2,172,480 | 9/1939 | Osmun | 175/297 |
| 2,309,872 | 2/1943 | Shaffer et al. | 175/297 |
| 2,364,869 | 12/1944 | Osmun | 175/297 |
| 2,474,459 | 6/1949 | Beck | 175/304 |
| 2,550,142 | 4/1951 | Dumble | 175/304 |
| 2,562,320 | 7/1951 | Lowe | 175/304 |
| 2,562,321 | 7/1951 | Lowe | 175/304 |
| 2,721,056 | 10/1955 | Storm | 175/304 |

*Primary Examiner*—James A. Leppink
*Attorney, Agent, or Firm*—Christie, Parker & Hale

[57] ABSTRACT

A well jar has telescoping inner and outer elements having a torque transmitting connection therebetween. An intermediate member is rotatably mounted relative to the telescoping elements and is affixed in a longitudinal direction to one of the telescoping elements. A releasable latch is connected between the intermediate member and one of the telescoping elements. The intermediate member is rotatable relative to the telescoping elements upon a predetermined minimum longitudinal force applied between the telescoping elements. The rotation causes a release of the latch and movement of the telescoping elements to an impact of coacting impact faces on the telescoping elements. An improvement involves a time delay section connected between the intermediate member and at least one of the telescoping elements for restraining such relative rotation for a preselected time interval of application of at least such minimum longitudinal force. In addition the preferred embodiment has the time delay section and the latch located in a common chamber, and the time delay section includes a hydraulic time delay device that makes use of the same fluid as that used for lubricating the latch.

37 Claims, 13 Drawing Figures

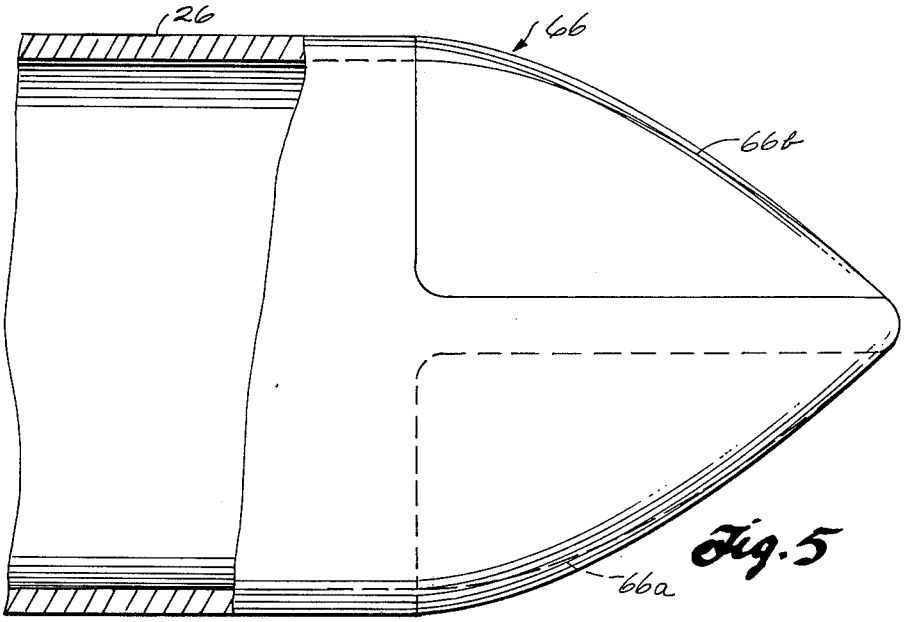
Fig. 5
Fig. 6
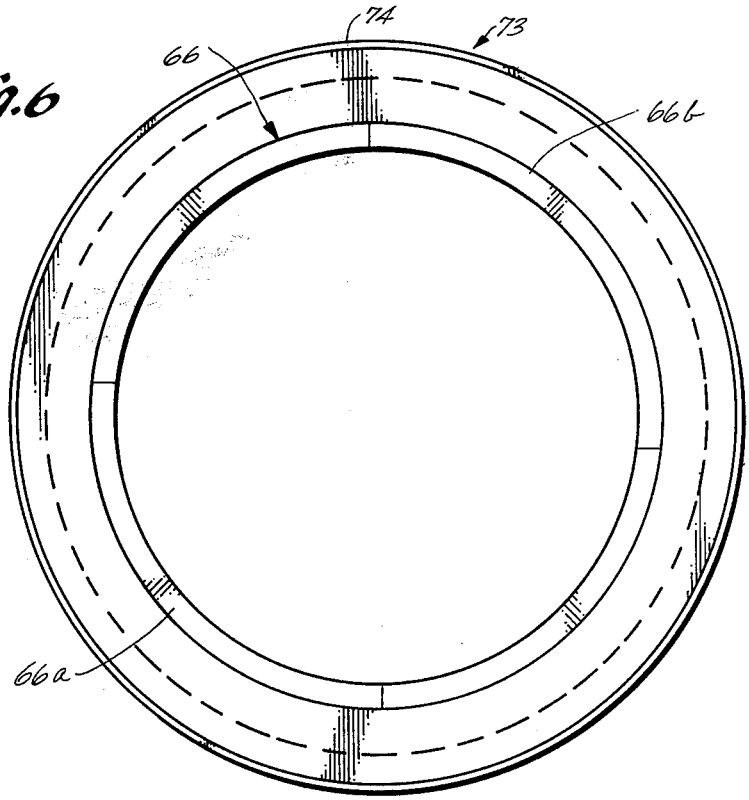

WELL FOR HAVING A TIME DELAY SECTION

BACKGROUND OF THE INVENTION

This invention relates to drilling tools and more particularly to a straight pull variable impact jarring mechanism for releasing objects stuck in a well bore.

Well jars are known for imparting sharp jarring forces to an object stuck in a well bore. One prior art well jar has tubular shaped inner and outer telescoping elements. Inclined surfaces are affixed on the inner mandrel, and a roller, for each inclined surface, is mounted on the outer telescoping element. Each roller and corresponding inclined surface form a latch. An elongated open space extends in the inner element along the ends of the inclined surfaces into which the rollers move upon release of the latches. Coacting impact faces, one on each of the telescoping elements, impact at one extremity of longitudinal movement of the telescoping elements. One of the telescoping elements is for connection to the lower end of an upper drill string and the other telescoping element is for connection, for example, to an object stuck in a well bore. The latches hold the telescoping elements against relative longitudinal movement. In one mode of operation the latches are released by rotating the telescoping elements until the rollers and inclined surfaces of the latches are disengaged at which time the rollers enter the opening and the telescoping elements are allowed to freely move longitudinally relative to each other under an applied longitudinal force, causing the coacting impact faces to impact. Alternately, a torsion can be applied through the drill string to the corresponding telescoping element causing the inclined surfaces and rollers to be urged toward the latched position. A downward longitudinal force on the drill string of sufficient magnitude will cause an interaction of the rollers and inclined surfaces which rotates the telescoping elements against the applied torsion until the rollers reach the elongated opening, allowing the longitudinal force to drive the coacting impact surfaces into impact. Such an arrangement relies on torsion applied to the drill string to determine the magnitude of the longitudinal force required for a release of the latches. Additionally, the magnitude of the impact of the coacting faces depends on the magnitude of the torsion in the drill string. With such an arrangement, it is difficult to determine precisely the torsional forces on the jar, particularly when it is at the lower or end of a very long drill string. Additionally, momentary longitudinal forces on the jar, such as those caused by sudden braking of the drill string, may cause the jar to inadvertently release during a drilling operation. Additionally when rotating the drill string the inner and outer telescoping elements rotate relative to one another in one direction until the rollers engage the inclined surfaces and in the opposite direction until stops engage.

An alternate prior art well jar also utilizes tubular shaped inner and outer telescoping elements with coacting impact faces. However, this device is provided with a tubular shaped intermediate sleeve member which carries inclined surfaces defining lateral notches. A longitudinally extending opening extends into the intermediate member along the ends of the notches. The inner telescoping element carries lugs which combine with the inclined surfaces to form latches. A spline connection is provided between the inner and outer telescoping elements to transmit torque directly from one to the other during a drilling operation. A torque spring is connected between the outer telescoping element and the intermediate member which rotates the intermediate member in a direction which engages the lugs in the notches. A longitudinal force applied in one direction between the telescoping elements will cause the adjacent surfaces of the notches and lugs to slide relative to each other, causing the intermediate member to be forced to rotate against the urging of the torsion spring. When the force on the intermediate member is of sufficient magnitude to overcome the torsion spring, the rotation is sufficient that the lugs enter the longitudinal opening at which point the telescoping elements freely move longitudinally relative to each other to one extremity where the coacting impact faces strike. With the splined connection between the inner and outer telescoping elements, a direct torque drive is provided between the telescoping elements during a drilling operation. However, momentary longitudinal forces applied between the telescoping elements of sufficient magnitude to overcome the torsion spring will cause the latches to release even though the user does not want the jar to release at that moment.

A further alternate prior art well jar also has inner and outer tubular telescoping elements. An elongated opening and lateral V-shaped notches opening into the opening are provided in the inner telescoping element. Latches are formed by a V-shaped wedge for each notch, on the outer telescoping element. The notches and wedges of each latch have adjacent inclined surfaces which slide against the adjacent surface to cause a relative rotation of the telescoping elements. With the V-shaped notches and wedges, either tension or compression longitudinally between the telescoping elements will force the inner and outer telescoping elements to rotate relative to each other until the wedges enter the elongated opening and release, allowing the telescoping elements to move longitudinally until the coacting impact faces come together. A coupling on the inner telescoping element has a spline connection to the outer telescoping element for transmitting torque directly between the outer telescoping element and the coupling. The inner telescoping element is rotatable relative to the coupling, as well as the outer telescoping element, and a torsion spring is connected between the inner telescoping element and the coupling for urging the notch and wedges into engagement. Couplings for connection to an upper drill string and to a stuck object are provided on the coupling and outer telescoping element. Similar problems exist with respect to this device as mentioned with respect to the prior mentioned device.

SUMMARY OF THE INVENTION

A well jar embodying the present invention has telescoping inner mandrel and outer body elements. A connector is provided on each of the telescoping elements. An interconnection is provided between the telescoping elements for transmitting torque therebetween and is adapted to permit relative longitudinal movement therebetween. An intermediate element is rotatably mounted relative to and intermediate the telescoping elements and is affixed longitudinally relative to a first one of the telescoping elements. A releasable latch is connected between the telescoping elements. A releasable latch is connected between the intermediate element and one of the telescoping elements. The releasable latch prevents relative longitudinal movement of the intermediate and telescoping elements. Longitudinal relative movement between the telescoping elements causes the latch to impart relative rotation, between the intermediate element and such one telescoping element, to a release position wherein the releasable latch permits substantially free longitudinal movement between the telescoping elements. Time delay means is connected between the intermediate element and one of the telescoping elements for restraining the relative rotational movement to the release position for a preselected time interval of application of a longitudinal force between the telescoping elements. Coacting impact faces, one on each of the telescoping elements, are positioned for contact at an end of the longitudinal movement.

With such an arrangement, longitudinal force between the telescoping elements is the sole external force which will cause the latch to release. Thus, torsional forces in the drilling string do not affect the amount of longitudinal force required to release the latch. Only the applied longitudinal force determines when a release occurs and determine the magnitude of the impact. Additionally, momentary oscillations such as tension or compression in a drill string connected to the jar, do not cause the jar to release even if the force required for triggering the jar is momentarily exceeded. Only if the force persists for the preselected time interval does the jar release.

Preferably, a torsion spring is provided for urging the intermediate element with respect to the telescoping element away from the release position and predetermines a minimum amount of longitudinal force required to cause relative rotation, between the intermediate and the one telescoping element, to the release condition.

A preferred embodiment of the invention has a time delay means with a converter for converting the rotational movement of the intermediate element into a linear longitudinal movement in the jar. A timer restrains the linear longitudinal movement for the preselected time interval.

According to a further preferred embodiment, the time delay means is hydraulically controlled and includes a substantially fluid tight chamber extending longitudinally of the jar for containing a fluid. A piston is slidable longitudinally of the jar in the chamber and provides a substantially fluid isolated chamber portion on each end of the piston. A fluid flow regulator provides fluid flow by passing the piston from one chamber portion to the other to allow only a substantially constant flow of fluid, with variations in force on the piston. These and other preferred embodiments and features of the time delay mechanism disclosed in the present invention provide a construction of low maintenance and reliable operation. As a result the preselected time delay can be selected and remains constant over substantially the entire range of expected longitudinal forces.

According to a further preferred embodiment the piston and the latch mentioned above are in a common chamber which has a common fluid for timing and for lubrication purposes. Preferably the timer is arranged downwardly from the latch so that air bubbles and light fractions of fluid will rise and not affect the the timer for operation of the piston. Preferably, a compensating seal is positioned at one end of the chamber to allow expansion of the chamber volume with expansion of the fluid in the chamber such as by changes of temperature of the fluid.

According to a still further preferred embodiment, a constant fluid control piston part is provided for a well jar. The piston part has an elongated tubular shaped element having first and second ends and a diametrically enlarged and elongated circular central piston portion. A cam is provided at the first end and forms, when viewed from such end, at least a segment of a circle which is coaxial with respect to the piston portion and has, when viewed from a side, an inclined cam surface. At least one elongated finger member extends longitudinally from the second end of the piston part and forms, when viewed from such end, a segment of a circle which is coaxial with the piston portion. At least first and second passages extend between the ends of the central piston portion for a constant fluid flow regulator and a check valve.

BRIEF DESCRIPTION OF THE DRAWINGS

FIG. 1-A is an enlarged section view taken at the circled portion of FIG. 1 showing the structure of the two-way filler valve adjacent to the compensating seal;

FIG. 5 is a side elevation view of the lower end of the intermediate member showing the longitudinally facing and inclined cam surfaces;

FIG. 6 is an end elevation view of the inclined cam surfaces of FIG. 5;

DESCRIPTION OF THE INVENTION

Figure 1:
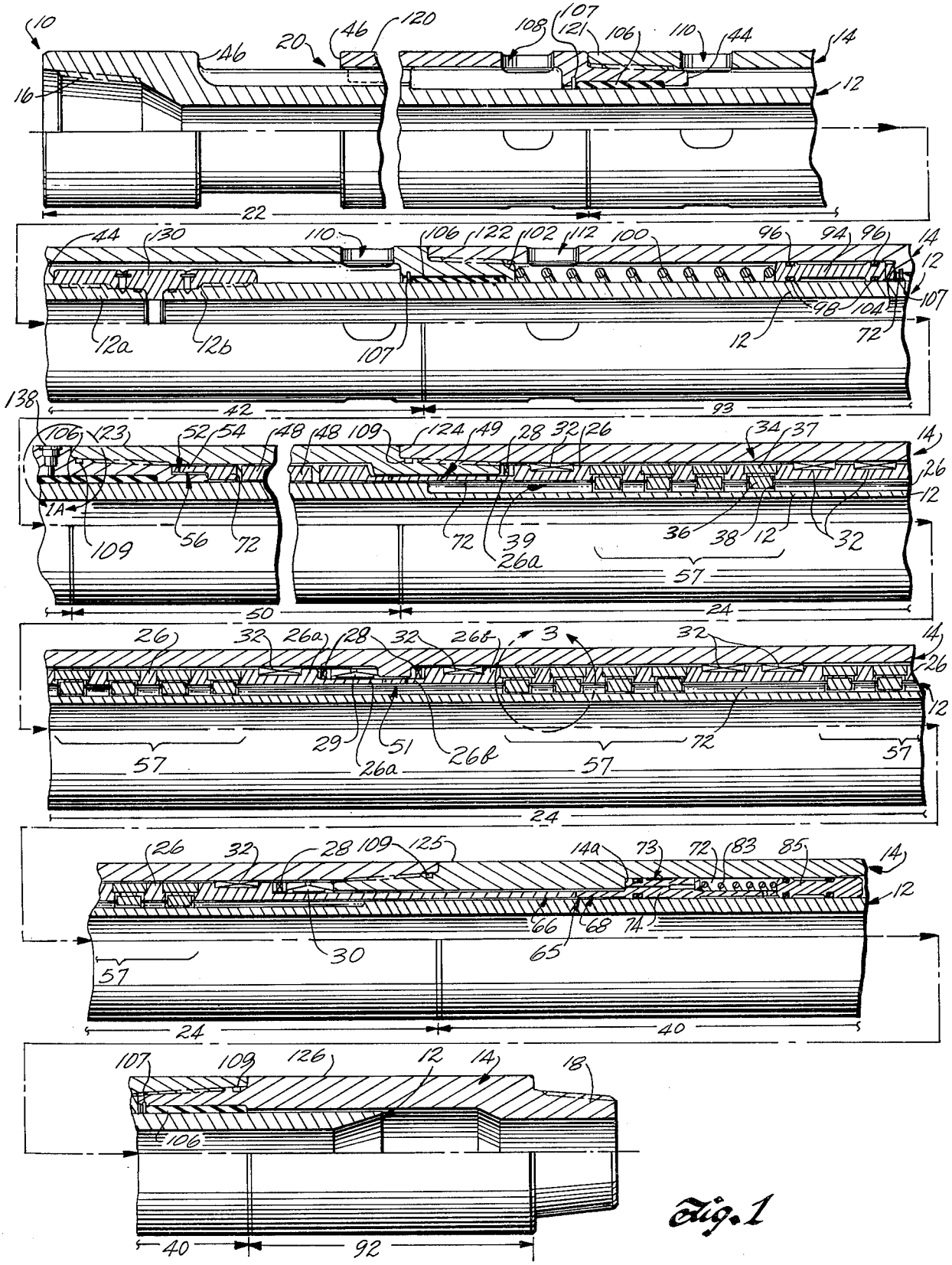
FIG. 1 is a reduced side assembly view of a well jar with a quarter section removed along one side to reveal the internal structure, and embodying the present invention.

FIG. 1 is a side elevation view of a well jar 10 with a quarter section cut away to expose the internal parts thereof and which embodies the present invention. The well jar has telescoping inner tubular and outer tubular body elements 12 and 14, respectively. The elements 12 and 14 are made of metal strengthened by heat treatment or by other known techniques, as required to prevent wear and breakage.

A female internal thread type connector 16 is provided at the upper exposed end of the inner element 12 for connection to the lower end of an upper drill string. A pin or male external thread type connector 18 is provided on the extreme opposite lower end of the outer element 14 for connection to the lower drill string or an object stuck in a well bore. The center of the inner element 12 allows circulation of drilling fluid, such as mud.

An interconnection is provided between the telescoping elements 12 and 14 for transmitting torque therebetween but allowing relative longitudinal movement between the telescoping elements. The connection is a spline connection 20 which includes inwardly longitudinally extending parrallel splines on the outer body element 14 and outwardly extending splines on the inner mandrel element 12 which allow relative longitudinal sliding movement. The spline connection 20 forms a portion of a torque drive section 22 allowing torque applied to the inner element 12 to be transmitted directly through the spline 20 to the outer element 14, bypassing the outer parts such as the latch.

A latch mechanism or section 24 has an intermediate element in the form of a generally tubular shaped latch member 26 which is rotatably mounted relative to and intermediate the inner and outer telescoping elements 12 and 14. The intermediate latch member 26 is separated in a longitudinal direction from the outer element 14 by anti-friction thrust bearings 28. Two ring springs 29 and 30 prevent longitudinal movement of the intermediate member 26 relative to the outer telescoping element 14 while allowing relative rotation therebetween. To be explained in more detail, the intermediate member 26 has upper and lower parts **26*a* and 26*b* interconnected by a finger spline 51. Also the upper part 26*a* is connected to a torsion spring 48 by a finger spline 49. The ring springs 29 and 30 load the upper and lower parts 26*a* and 26*b* to the left as seen in FIG. 1 so as to maintain contact with thrust bearings 28. Bushings 32 rotatably mount the intermediate member 26 on the interior wall of the tubular shaped outer element 14**.

The latch section 24 includes a plurality of latches 34. Each latch 34 includes a first part in the form of a roller 36 whose axis extends along a radius towards the center line of the well jar. Each roller is rotatably mounted on a bearing spindle 37 which is affixed to the intermediate latch member. The bearing is positioned in a circular recess from the exterior of the tubular shaped intermediate latch member 26.

Each latch includes a second part on the inner element 12 in the form of a cam 38. The cam 38 is engageable with the roller 36 when latched so as to prevent relative longitudinal movement of the intermediate latch member 26 with respect to the inner element 12 and as a result prevents relative longitudinal movement of the telescoping elements 12 and 14. To be explained in more detail, relative rotation of the intermediate latch member 26 and the inner element 12 to a breakaway position of the latch allows the roller 36 to move into a longitudinally elongated opening 39 in the inner element 12, allowing the roller 36 (and hence the intermediate latch member 26) to move longitudinally relative to the inner element 12. Also to be explained in more detail, the cam 38 has an inclined cam surface which, upon application of longitudinal force either in compression or in tension between the inner and outer telescoping elements 12 and 14, causes the intermediate latch member 26 to rotate relative to the inner telescoping element 12 to the breakaway position of such latch parts.

Significant to the present invention there is provided a time delay means in the form of a timer section 40. The timer section is connected between the intermediate latch member 26 and the outer element 14 and restrains relative rotational movement of the intermediate latch member 26 to the breakaway position for the latches for a preselected time interval of application of longitudinal compression or tension forces between the inner and outer telescoping elements 12 and 14. Details of the timer section will be described in connection with FIG. 2.

A hammer section 42 has coacting impact faces 44 which strike or impact upon application of tension forces between the inner and outer telescoping elements 12 and 14. Impact faces 46 impact under compression applied between the telescoping elements 12 and 14.

Resilient means in the form of the torsion spring 48 is provided in a torsion spring section 50. The torsion spring 48 is connected by an involute spline 52 on a collar 54 to a spline on an annular extension 56 on the outer element 14. The other end of the torsion spring 48 is affixed radially through the semicircular finger spline connection 49 to one end of the intermediate latch member 26. The torsion spring 48 is preloaded about the longitudinal axis of the jar between the outer element 14 and the intermediate latch member 26 so as to rotate the intermediate latch member relative to the inner element 12 until the rollers 36 are bottomed in the cams 38. As will become evident during the following discussion, relative rotation to the engaged position of the latch 34 can only occur when the inner and outer telescoping elements 12 and 14 are longitudinally moved to the position where the roller 36 and cam 38 of all latches 34 are longitudinally aligned.

Figure 3:
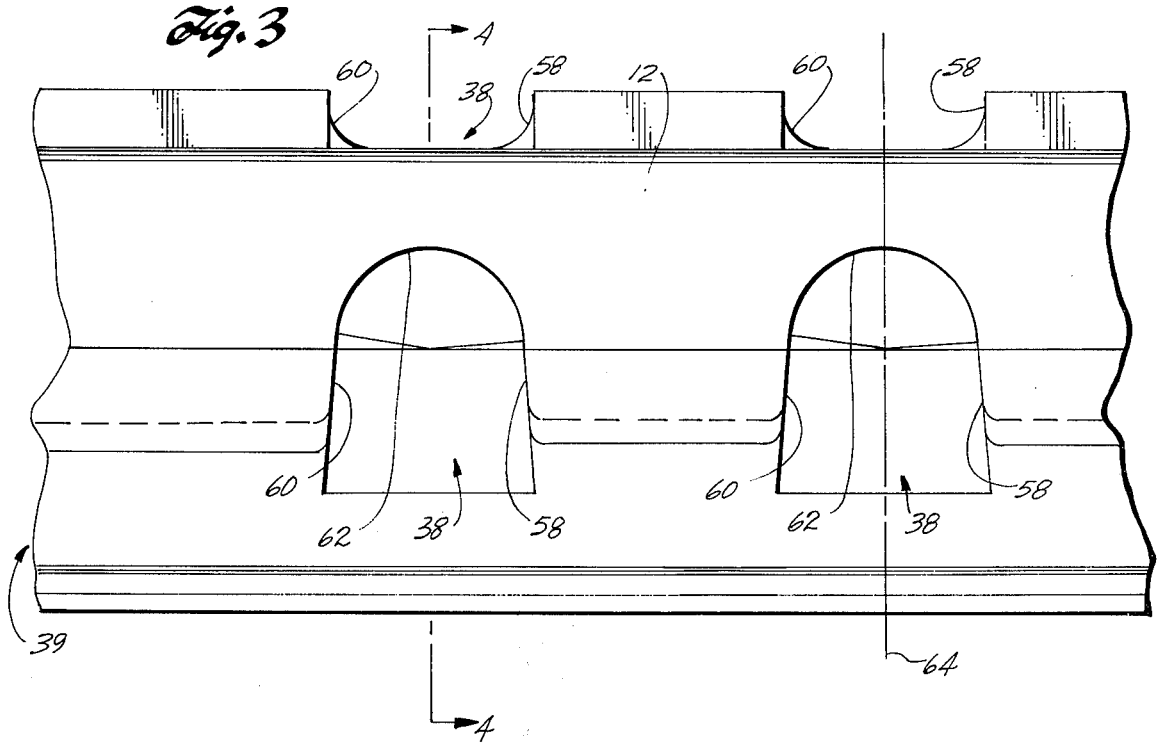
FIG. 3 is a side elevation view of the inner mandrel with the rollers removed, taken from the circled portion of FIG. 1.
Figure 4:
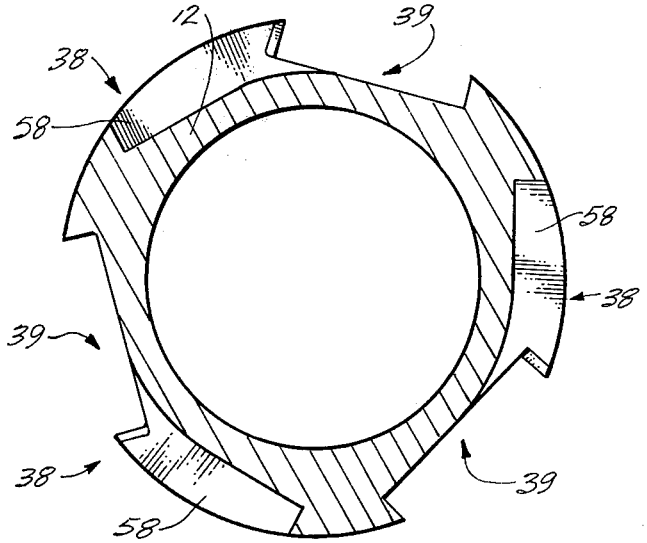
FIG. 4 is a cross-sectional view of the inner mandrel taken along line 4—4 of FIG. 3.

Consider now in more detail the arrangement of the latches 34. The latches 34 are arranged into groups 57. Four groups of latches 57 are positioned in a straight line extending longitudinally along the inner element 12 and the intermediate latch element 26. Each group has four latches 34 and each group is separated longitudinally with respect to the adjacent group. FIG. 3 is an enlarged view of the inner mandrel 12 in the circled area indicated in FIG. 1. FIG. 4 is a cross-sectional view of the inner mandrel 12 taken along line 4—4 of FIG. 3. In addition to the four longitudinal groups seen in FIG. 1, for each group seen in FIG. 1 there are two additional groups of latches 57 angularly spaced at 120° increments around the inner mandrel 12. The three angularly displaced lines of latches 34 are generally indicated by the three angularly displaced cams 38 and openings 39 depicted in the cross-sectional view of the inner element 12 shown in FIG. 4.

As described above, each latch 34 contains a roller 36 mounted on the intermediate member 26 and a cam 38 in the inner mandrel 12. Referring to FIGS. 3 and 4, each cam 38, as best depicted in FIG. 3, has two facing but diverging inclined surfaces 58 and 60 which diverge outwardly from a bottom 62 of the cam towards the elongated opening 39. The surfaces 58 and 60 are inclined and diverge helically with respect to a center line 64 which is a tangent to the inner element 12 and is also perpendicular to the central axis of the inner element 12. As depicted in FIGS. 1, 3 and 4, longitudinally elongated opening 39 is provided along each line of latches. The elongated opening 39 extends in a straight line along the inner element 12 in communication with the openings of each of the cams 38 disposed along the same longitudinal line.

Thus the torsion spring 48 urges the intermediate latch member 26 relative to the inner element 12 so that the rollers 36 engage the bottom 62 of the corresponding cam.

Consider briefly the operation assuming that there is no effect due to the time delay section 40. When a longitudinal compressive force is applied between the inner and outer telescoping elements 12 and 14, such as occurs when the outer element 14 is fixed and a downward force is applied to the upper drill string connected at 16, each roller 36 will roll on the corresponding inclined surfaces 60, forcing the intermediate latch member 26 to rotate in a clockwise direction as viewed from the connector 16 end of the jar. Rotation continues until the roller 36 reaches a release or breakaway position where it is in the corresponding elongated opening 39 whereupon the inner element 12 drops downward free of the holding action of the rollers 36. The downward movement of the inner element 12 continues until the coacting impact faces 46 strike, imparting a sharp downward impact force to a stuck object connected to the connector 18. A similar action occurs when tension is applied between the elements 12 and 14 such as occurs when the outer element 14 is fixed and the inner element 12 is pulled upward. Tension will cause each roller 36 to bear against the lower surface 58 of the corresponding cam 38 forcing the intermediate latch member 26 to rotate clockwise, viewed from connector 16, until the rollers reach the unlatched or breakaway position and enter the corresponding elongated opening 39. When this occurs the inner element 12 moves upwardly with respect to the intermediate latch member 26 and the outer element 14 with the rollers traveling in the corresponding opening 39 until the coacting impact faces 44 strike, imparting a sharp upward blow to a stuck object connected to the lower connector 18.

It will now be seen that the torsion spring 48 applies a torque which restrains the rotation of the intermediate latch member 26 relative to the inner and outer telescoping elements 12 and 14 until a minimum amount of longitudinal force is applied between the telescoping elements. By increasing the spring preload the amount of force required to rotate the intermediate latch member 26 to the breakaway position of the latches 34 is increased.

Figure 2:
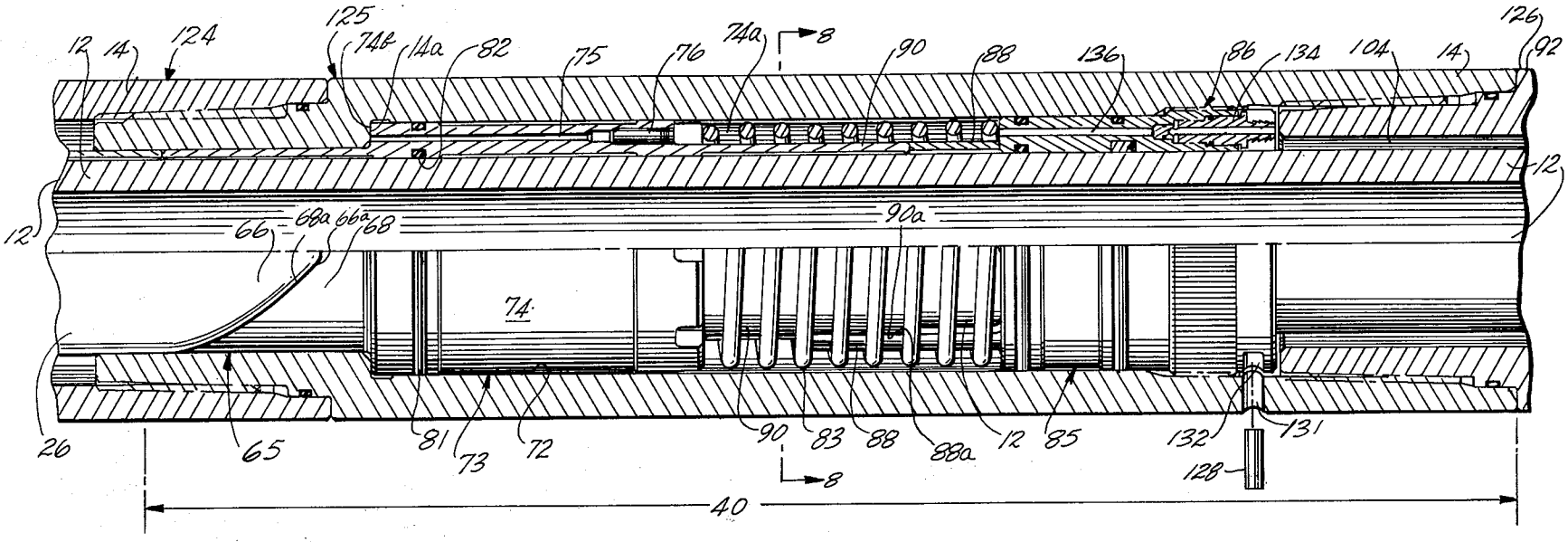
FIG. 2 is an enlarged cross-sectional view of the timer section of FIG. 1 and embodying the present invention.
Figure 1A:
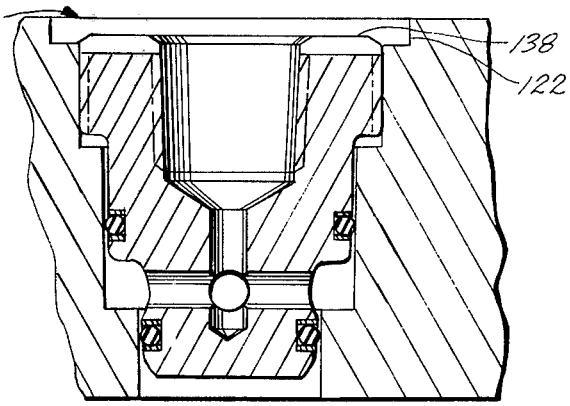
Figure 7:
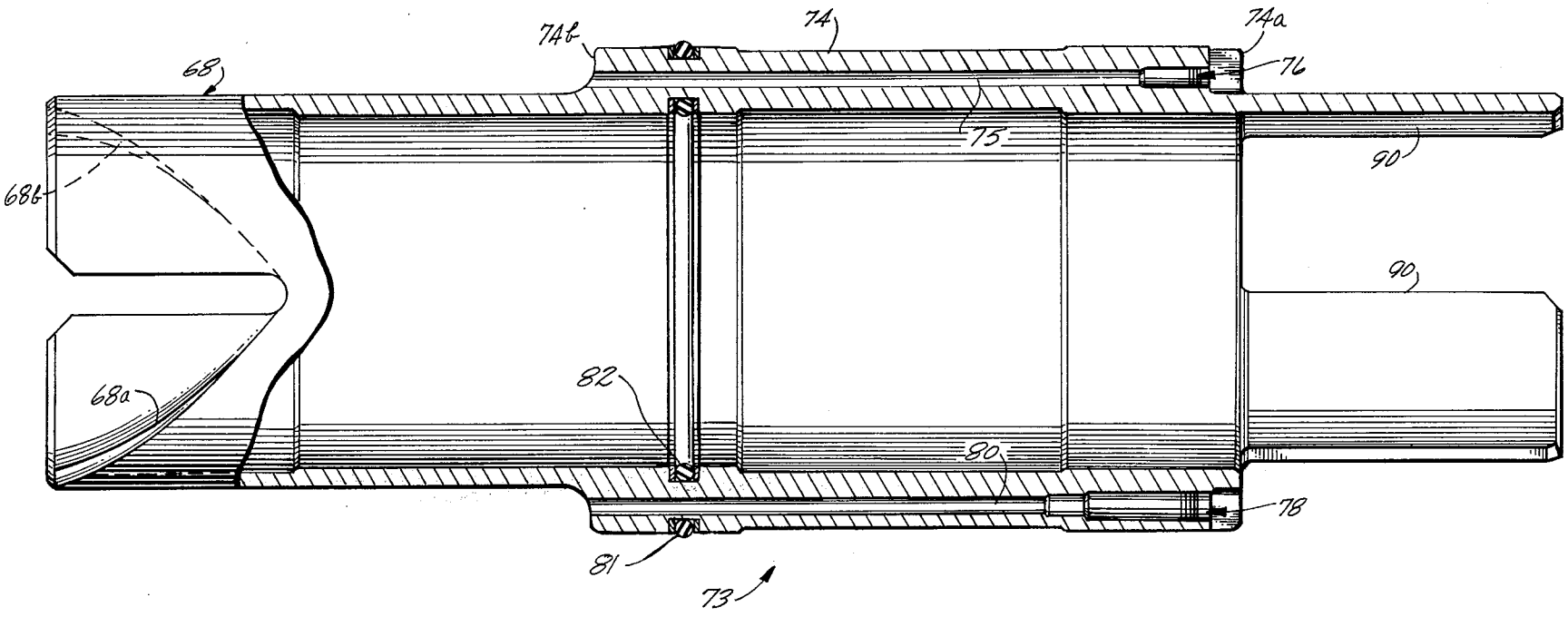
FIG. 7 is a cross-sectional view of the tubular piston member used in the timer section, showing the constant fluid flow regulator and the check valve in full side elevation.
Figure 8:
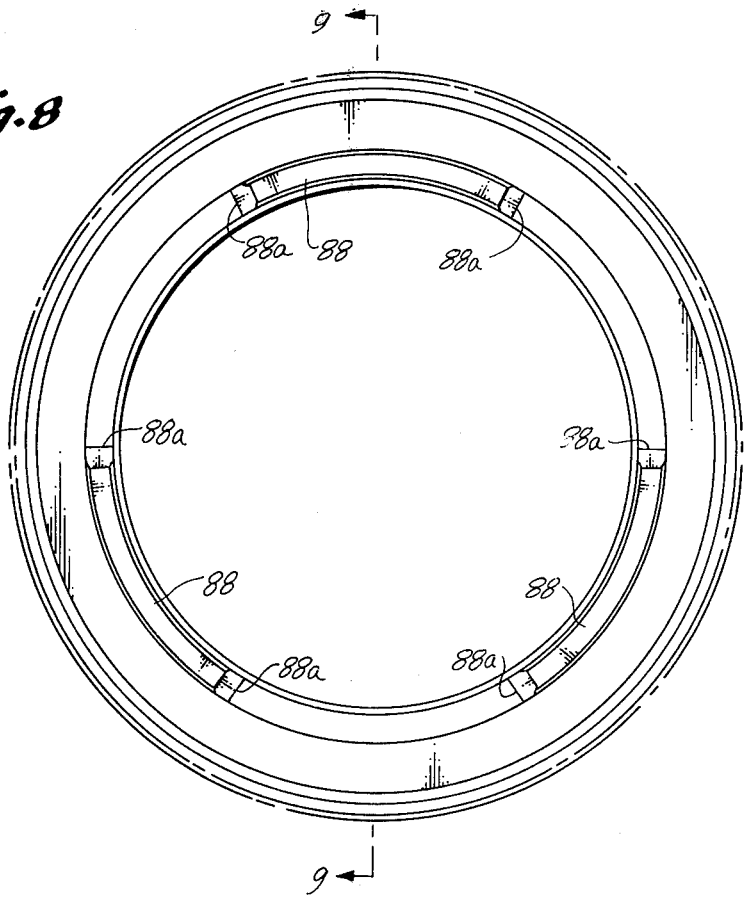
FIG. 8 is an end elevation view of the static timer seal cartridge taken along line 8—8 of FIG. 2.

Refer now to the timer section 40 as best seen in FIG. 2. The timer means or section 40 is connected between the intermediate latch member 26 and the outer element 14 for restraining the relative rotational movement of the intermediate latch member 26 so that the breakaway position of the latch is not reached for a preselected time interval. The time interval is measured beginning with the time at which sufficient longitudinal force is applied between the telescoping elements to overcome the counteracting preload of the spring 48. Included therein is a converter 65 for converting the rotational movement of the intermediate latch member 26 into a linear longitudinal movement in the jar. The converter 65 includes a first part 66 on the intermediate latch member 26 and a second part 68 on a tubular part 73. The parts 66 and 68 have facing inclined cam surfaces **66*a* and 68*a*, respectively, best seen in FIGS. 2, 5 and 7, which slidably engage each other. With this arrangement, rotation of the intermediate latch member 26 causes rotation of part 66 which in turn causes the surfaces 66*a* and 66*b* to rotate relative to each other. The part 68 is fixed so it cannot rotate and hence rotation of the surfaces 66*a* and 68*b* causes a force against inclined surfaces 68*a* and 68*b* causing a longitudinal movement of the part 68 to the right as viewed in FIGS. 2 and 7. In this connection it should be noted that the intermediate latch member 26 will always move in the clockwise direction as viewed from the connector 16** end of the jar.

Timer section 40 has a substantially fluid-tight circular annular shaped chamber 72 which extends longitudinally in the jar for containing a fluid such as oil. The tubular part 73 includes a diametrically enlarged centrally located piston 74 which is elongated in a longitudinal direction in the jar and slidable in a longitudinal direction within the chamber. The piston 74 provides a substantially fluid-isolated chamber portion on each end thereof. The piston 74, similar to the intermediate latch member 26, is tubular shaped so that it slides along between the outer surface of the inner element 12 and the inside surface of the outer element 14.

At one angular position of the piston 74 there is provided a regulator 76. The regulator 76 is a constant fluid flow type regulator that only allows a substantially constant rate of flow of fluid through the piston 74 from end **74*a* to end 74*b* over the expected variations in force created by the rotational to linear converter 65 under longitudinal force between the telescoping elements 12 and 14. The regulator 76 is positioned in a passage 75 which extends between the ends 74*a* and 74*b*.**

In addition to the regulator 76, which provides a substantially constant fluid flow from end **74*a* to end 74*b*, a check valve 78 is provided. The check valve 78 is located in a passage 80 extending between the ends 74*a* and 74*b* of the piston 74. The check valve 78 blocks the flow of fluid from end 74*a* to end 74*b* but allows fluid to freely flow from end 74*b* to 74*a*.**

There is one additional constant flow regulator 76 in a separate angularly displaced passage 75 (not shown) identical to the one discussed above. Also there are 13 additional check valves 78 separately positioned in 14 additional angularly displaced passages 80 (not shown), identical to the one described above. The passage 75 (and the respective flow regulators 76) and the passages 80 (and the respective check valves 78) are all connected in between the ends **74*a* and 74*b* of the piston in the same direction as the one described. The invention is not limited to any specific number of passages and regulators and check valves, the aforementioned being given by way of example. Although not essential to the invention, 16 passages are positioned at equal angular positions and extend in between ends 74*a* and 74*b*, two of which are used as passage 75 (with regulators 76) and fourteen of which are used as passages 80 (with check valves 78). In one embodiment it has been found desirable to position the regulators 76 in the passages 75 adjacent the end 74*b* rather than the end 74*a* and place a screen over the passage at the end 74*a*** in order to prevent foreign particles in the fluid from altering the time delay of the regulators.

The regulators 76 are type 281 Flosert, made by the Lee Company. A screen (not shown) covers the end of the regulator 76 facing to the right to prevent particles from entering the regulator. The check valves are size 187 made by the Lee Company. However, these devices are given by way of example and the invention is not limited thereto.

The ends of the piston 74 are sealed between the outer wall of the piston 74 and the inner wall of the outer body element 14 by o-ring 81 positioned partially in an annular groove around the periphery of the piston 74. The ends of the piston 74 are sealed in between the inner wall of the piston 74 and the outer wall of the inner element 12 by an o-ring 82 partially in an annular groove around the inner periphery of the piston 74.

In operation, when longitudinal force is applied between the telescoping elements 12 and 14 of sufficient magnitude to overcome the restraining force of the torsion spring 48, the intermediate member 26 starts to rotate relative to the inner and outer telescoping elements 12 and 14 towards the breakaway position of latches 34. However, the tendency to rotate is converted to a linear motion by the converter 65 thereby applying a force to the piston 74 tending to move it to the right hand end of chamber 72 as seen in FIG. 2. As a result, pressure builds up on the end 74*a* of the piston 74. Such flow of fluid is blocked by the check valve 78 but is permitted to flow by the regulator 76 through the passage 75 to the end 74*b*. The regulator 76 being a constant flow type regulator, allows a metered amount of flow to occur. After sufficient fluid has passed through the regulator to the end 74*b* of the piston to allow the piston 74 to move longitudinally to the point where the intermediate member 26 may rotate to the breakaway position of the latches, then the longitudinal movement of the telescoping elements 12 and 14 and the hammer action discussed above occur.

A spiral compression spring 83 is positioned in the chamber 72 and bears against the end 74*a* of the piston 74. The jar is reset after release of the latches by relatively moving telescoping elements 12 and 14 until the rollers line up with and rotate into engagement with the the corresponding cams under the force of the spring 48. After this occurs the pressure between the parts 66 and 68 is relieved, allowing the spiral spring 83 to force the piston 74 to the left to its initial position where the end 74*b* abuts against the inwardly extending shoulder 14*a* of the outer body element 14.

Figure 9:
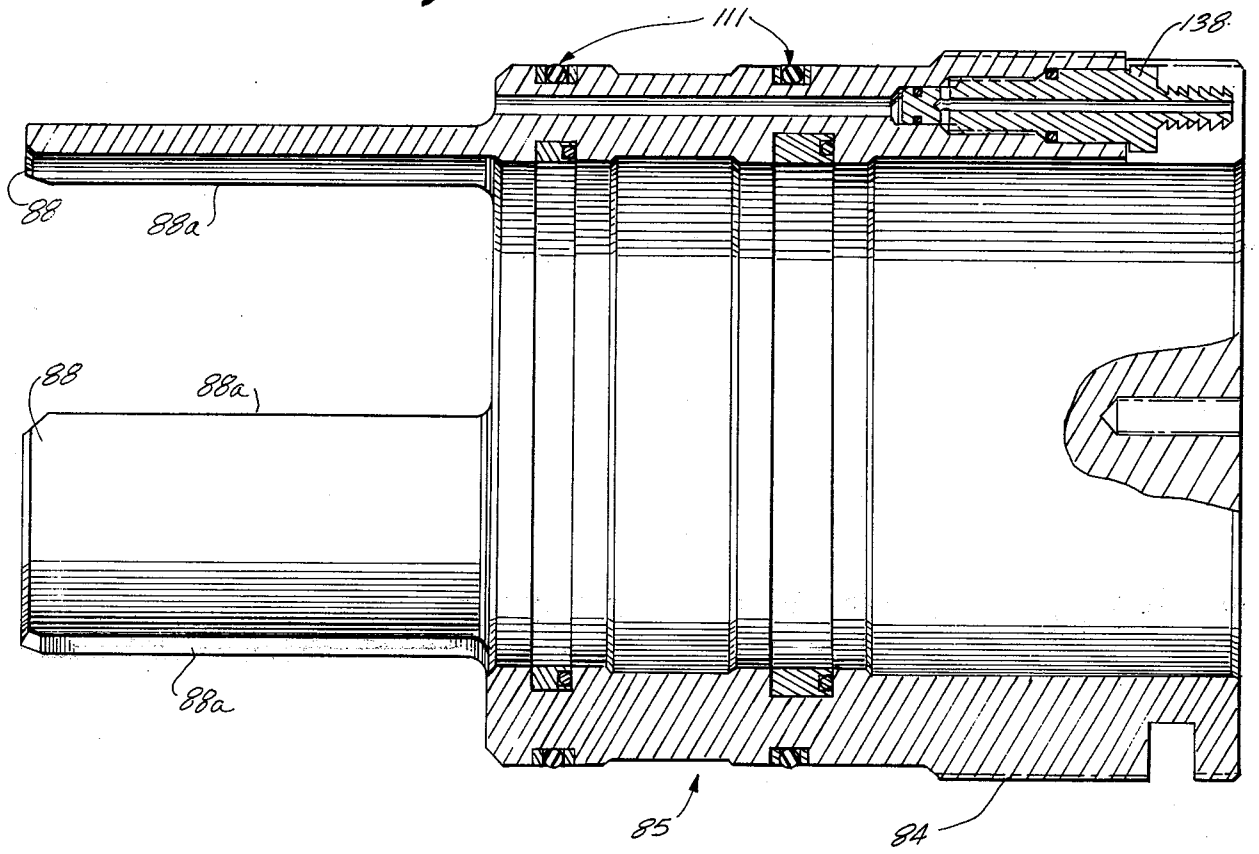
FIG. 9 is a cross-sectional view of the static timer seal cartridge and the two-way filler plug taken along line 9—9 of FIG. 8.

The jar contains a static timer seal cartridge 85. The seal cartridge 85 contains a male involute spline 84 which engages with a female spline formed on the interior of the outer body element 14. The engaging splines 84 and 86 prevent the static timer seal cartridge 85 from rotating and in turn prevent the piston 74 from rotating under force created by the latches. As best seen in FIGS. 2 and 9, the static timer seal cartridge 85 contains three longitudinally extending finger members 88 (only two being shown in the Figures). The fingers 88 form segments of a circle and are spaced apart by equal angles. The end 74*a* of the piston 74 has three axially extending fingers 90 which also form segments of a circle and extend in an axial direction and in between the sides 88*a* of the fingers 88 so as to form a finger spline connection. The sides 88*a* and 90*a* of the fingers 88 and 90, respectively, engage and, due to the rigid spline connection of the static timer seal cartridge 85, prevent the piston 74 from rotating while allowing sliding longitudinal movement of the surfaces 88*a* and 90*a* of fingers 88 and 90 as the piston 74 moves in a longitudinal direction. The opposite end of the spiral spring 83 from the piston 74*a* bears against the longitudinal facing surface of the static timer seal cartridge 85. An extension sub 92 carries the connector 18 at the lower end of the jar and at the opposite end of extension sub 92 a threaded male connector is provided for mating with a threaded female connector provided on the interior wall of the outer element 14. The extension sub 92 forms a plug which engages the lower end of the static timer seal cartridge 85 and prevents it from moving axially out of the lower end of the jar.

Significantly, the fluid chamber 72 is elongated and extends in between the inner and outer telescoping elements 12 and 14 from the static timer seal cartridge 85 to a compensating seal section 93 and hence includes both the timer section 40 and the latch section 24. As a result the same fluid which is used for controlling the timer section 40 is used for lubrication purposes in the latch section 24. Further, the latch section is positioned towards the splined connection 20 from the timer section 40 and is therefore positioned upwardly in the normally intended vertical position of the jar. As a result, lighter fractions of fluid created by bubbles, impurities, etc., in the fluid will tend to rise in the chamber 72 away from the piston 74 thereby providing a more reliable, constant delay period.

The compensating seal section 93 provides an expandable volume for the chamber 72. The compensating seal section 93 includes a tubular shaped seal 94 positioned between the inner and outer telescoping elements 12 and 14. Outer o-rings 96 are provided in annular grooves around the outer surface of the seal member 94 in order to provide a fluid-tight seal between the member 94 and the inner surface of the outer element 14. Similarly, o-rings 98 are provided in recesses in the inner surface of the member 94 so as to provide a fluid-tight seal between the member 94 and the inner element 12. With such an arrangement the member 94 is able to slide longitudinally between the inner and outer telescoping elements 12 and 14 and yet provide a fluid-tight seal for the chamber 72. A spiral compression spring 100 is positioned in an annular space around the inner element 12 and is disposed in a longitudinal direction in the jar between an end of the member 94 and an inwardly extending shoulder 102 of the outer element 14. The spring 100 urges the compensating seal member 94 towards an inwardly extending shoulder 104 of the outer body element 14. As the fluid in the chamber 72 expands, the seal member 94 will be forced towards the inwardly extending shoulder 102 thereby expanding the volume within the chamber 72. As the fluid volume decreases, the member 94 will move towards the shoulder 104 due to the force of the compression spring 100.

In order to facilitate the longitudinal sliding relative movement of the inner and outer telescoping elements 12 and 14, four annular bushings 106 are affixed to the outer element 14 and between the inner and outer telescoping elements 12 and 14 at longitudinally spaced apart positions for providing a sliding bearing between the elements.

Openings 108 in the torque drive section 22, openings 110 in the hammer section 42, and openings 112 in the compensating seal section 93, allow mud to circulate into the corresponding sections of the jar.

Although o-rings have been disclosed as seals herein it will be understood that other types of seals can be used as will be evident to those skilled in the art and are contemplated within the scope of the invention herein.

To facilitate the assembly of the jar, the outer body element 14 is arranged into separate outer body parts 120 through 126. Each outer body part has a threaded connection to an overlapping portion of the adjacent outer body part. Also the inner telescoping element 12 has an upper part 12*a* and a lower part 12*b* connected together by a threaded connector 130 which carries one of the impact faces 44.

Prior to the major assembly, the bushings 106 for the inner telescoping element 12 are mounted using the retaining rings 107. The tool joint seals 109 are inserted in the outer body connections. The seals 81, 82, 96, 98 and 111 are mounted in the seal cartridge assembly 85, the piston 84 and the seal member 94. The regulators 76 (and a screen for each regulator) and the check valves 78 are affixed in the piston 74 as described above.

The actual assembly of the well jar moving from left to right is as follows:

The outer body part 120 is slid onto the upper part 12*a* of the inner telescoping element 12, forming the spline connection 20. The connector 130 is threaded onto the upper part 12*a* and is affixed thereto with screws. The following elements are then placed on the lower part 12*b* of the inner telescoping element 12: outer body part 122, the seal member 94, the seal spring 100, the outer body part 121. The lower part 12*b* of the inner telescoping element 12 is then threaded into the remaining end of the connector 130 and affixed thereto by screws. The outer body parts 120, 121 and 122 are then threaded together.

The torsion spring 48 is positioned over the lower end 12*b* of the inner telescoping element 12 and the splines 56 thereof are engaged with the splines 52 on the outer body part 122. The outer body part 123 is positioned over the lower part 12*b* of the inner telescoping element 12 and threaded with the outer body part 122. The thrust bearing 28 is positioned over the front end of the upper part 26*a* of the intermediate member 26. The upper part 26*a* of the intermediate member 26 is positioned over the lower part 12*b* of the inner telescoping element 12 and the finger splines 49 are engaged at the lower end of the torsion spring 48.

The torsion spring 48 is then preloaded by twisting the front 26*a* of the intermediate member 26 counterclockwise, as viewed from the right hand end of FIG. 1, until the openings for the rollers in the upper part 26*a* of the intermediate member 26 line up with the corresponding openings 38 in the inner telescoping element 12. The rollers 36 are then positioned into the upper part 26*a* of the intermediate latch member 26, maintaining the preload for the spring 48. The split bushings 32 are positioned on the upper part 26*a* of the intermediate latch member 26 and the thrust bearing assembly 28 and the ring spring 29 are positioned at the lower end of the upper part 26*a* of the intermediate latch member 26. The outer body part 124 is slid over the upper part 26*a* of the intermediate element 26 and threaded together with the lower end of the outer body part 123.

The assembly is then unlatched and impact faces 46 touch. The thrust bearing 28 is then positioned over the upper end of the lower part 26*b* of the intermediate latch member 26. The lower part 26*b* of the intermediate latch member 26 is then slid over the lower part 12*b* of the inner telescoping element 12. The rollers are then positioned into the openings provided in the lower part 26*b* of the intermediate latch member 26. The lower part 26*b* is progressively pushed to the left as seen in FIG. 1 as the rollers are inserted in place until the finger spline 51 is fully engaged. The thrust bearing 28 and split ring spring 30 are positioned at the lower end of the lower part 26*b*. The outer body part 125 is then threaded into the outer body part 124.

The jar is subsequently latched and the tubular part 73 (carrying piston 74) is positioned over the lower part 12*b* of the inner telescoping element 12, fully engaging camming surfaces 66 and 68. The spiral compression spring 83 is then positioned about the tubular part 73 and the static timer seal cartridge 85 is positioned about the lower part 12*b*, compressing the spiral compression spring 83 until the finger splines 88 and 90 are fully engaged.

A slot 132 is provided at the right hand end of the static timer seal cartridge 85 in alignment with an opening 131 in the outer body part 125. A retaining pin 128 is positioned through the opening 131 into the slot 132 thereby holding the cartridge 85 with the spring 83 preloaded. Although the slot 132 is shown by way of example, it should be understood that an annular groove may be provided in the static timer seal cartridge for the pin 128 by appropriately extending the static timer seal cartridge to the right (as seen in FIG. 2) past the filler plug 134.

Two-way vacuum filler plugs 134 and 138, having threads on the exterior thereof, are respectively threaded into the static timer seal cartridge 85 and the end of the outer body part 122 which is adjacent to the outer body part 123. The two-way vacuum filler plug 134 communicates with one end of the chamber 72 via the passage 136. The two-way vacuum filler plug 138 communicates with the other end of the chamber 72 through an opening in the outer body part 122 and a relief in the adjacent annular bushing 106. It will be noted at this point that the outer body part 126 which is a part of the extension sub 92 has not been positioned in place, leaving the filler plug 134 (in the static timer seal cartridge 85) exposed.

Figure 11:
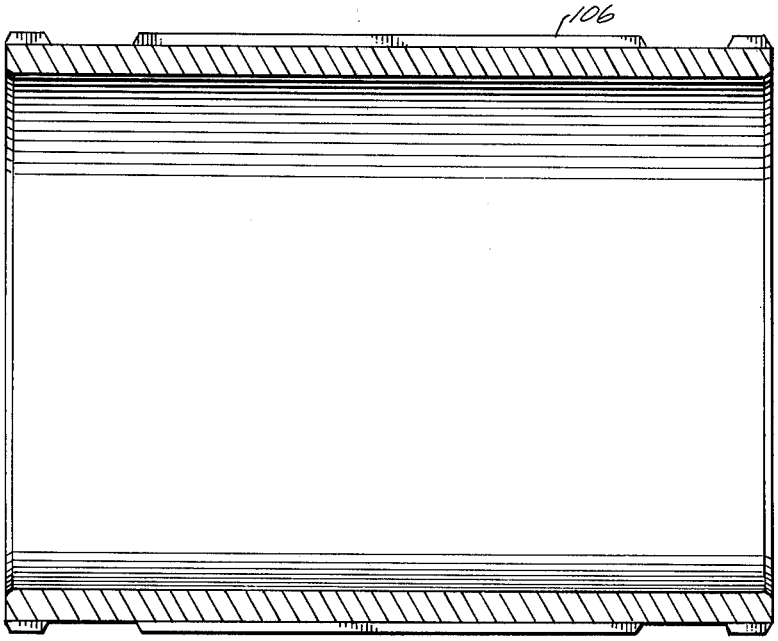
FIG. 11 is a cross-sectional view of the bushing 106 which is positioned under the two-way filler plug 138 in the area 1A of FIG. 1.
Figure 12:
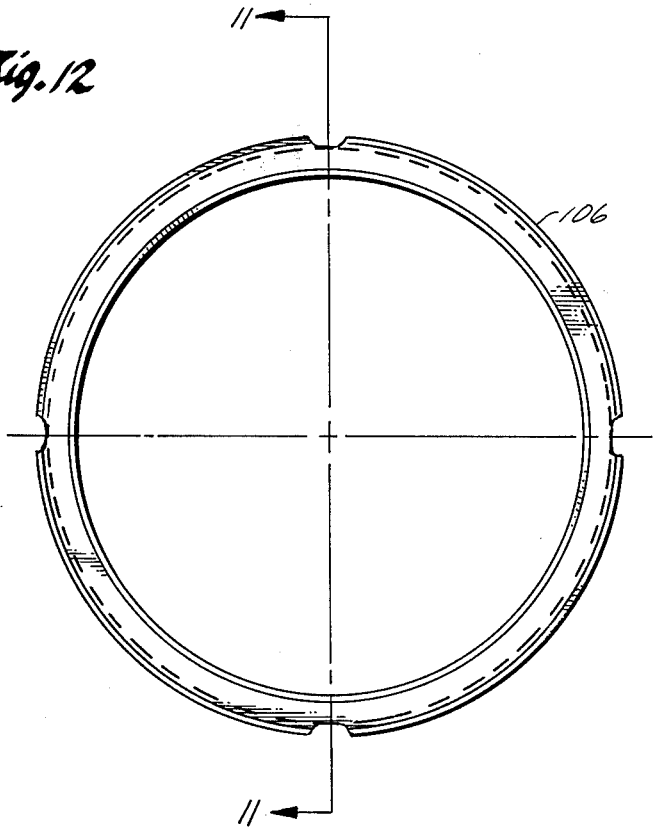
FIG. 12 is an end view of the bushing of FIG. 11.

FIG. 11 shows an enlarged cross-sectional view of the bushing 106 which is positioned under the two-way filler plug 138 at 1A of FIG. 1. FIG. 12 shows an end view of the same bushing. As indicated, the bushing shown in FIGS. 11 and 12 contains two annular grooves extending around the circumference of the bushing, and four longitudinal grooves, the latter spaced 90° apart. Depending on the direction in which the bushing 106 is inserted, one of the annular grooves is aligned with the two-way filler plug 138 thereby allowing fluid to freely flow into the annular groove through the longitudinal groove to opposite ends of the bushing. Additionally the longitudinal grooves allow fluid to move within the chamber 72 from one end of the bushing to the other.

The method and procedure for filling the well jar so as to completely fill the hydraulic timer section 40 and the latch mechanism chamber are quite important. In this connection it will be noted that the chamber 72 is separated into one chamber part at the right of piston 74 and a second chamber part at the left of piston 74. The regulators 76 and the check valves 78 provide a restricted flow for fluid between the ends of piston 74. Additionally the regulators and check valves have a minimum cracking pressure at which fluid will flow therethrough. Accordingly, care must be taken to ensure complete and uniform filling of the fluid into both chamber parts.

Figure 10:
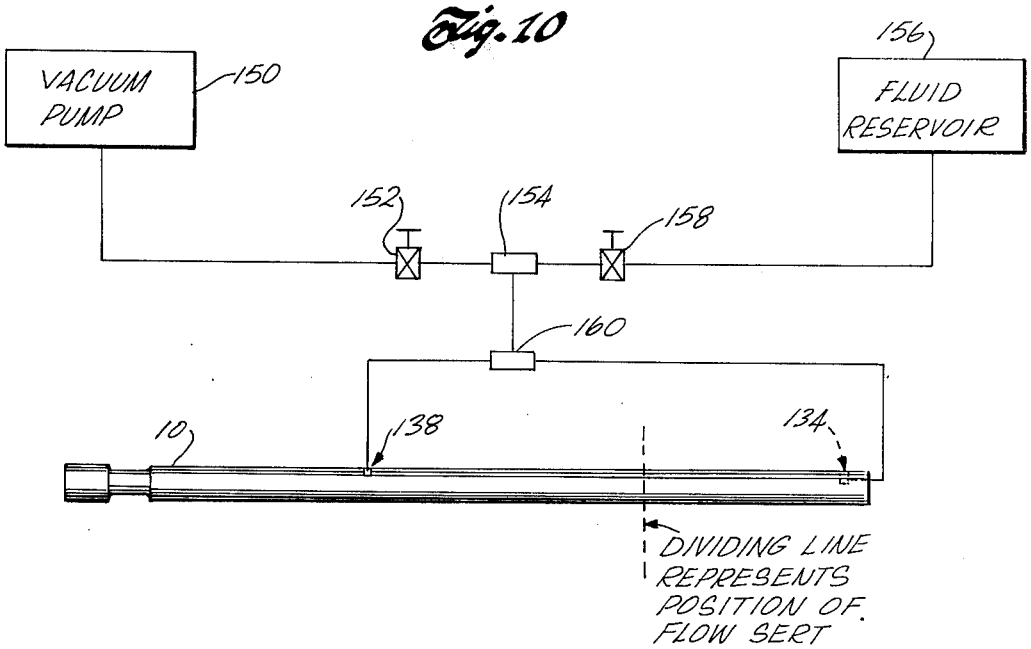
FIG. 10 is a schematic diagram depicting the apparatus used in practising the method of filling fluid into the chamber of the jar and embodying the present invention.

Referring to FIG. 10, a source of vacuum 150 is connected through a shutoff valve 152 to a tee fitting 154. Similarly, a reservoir 156 of fluid, of the type desired in chamber 72, is connected through another shutoff valve 158 to another side of the tee fitting 154. The remaining leg of the tee fitting 154 is connected through a second tee fitting 160 to the filler plugs 134 and 138.

The filler plugs 134 and 138 are rotated to a fill position leaving the lower o-ring of each plug out of the small hole of the corresponding opening so that a clear passage exists through both of plugs 134 and 138 into opposite ends of the chamber 72. Valves 152 and 158 are turned off so as to block the filler plugs from both of the sources 150 and 156.

Subsequently the shutoff valve 152 is opened, applying vacuum through tees 154 and 160 to the filler plugs 134 and 138, causing the chamber 72 to be evacuated. Also the vacuum is left on long enough to not only create a vacuum but to draw out undesirable fluids remaining in the chamber 72. With the vacuum maintained in the chamber 72, the shutoff valve 152 is turned off and the valve 158 is turned on, allowing fluid in the reservoir 156 to flow through the tees 154 and 160 through the filler plugs 134 and 138 and into the chamber 72 until the fluid completely fills the chamber 72 from opposite directions.

By this method it is possible to completely fill the chamber 72 with its many parts, shapes and angles with the restriction of the regulators and check valves, without leaving air bubbles. This is quite important since it is necessary to have a uniform fluid and a uniform fluid pressure for proper operation of the piston 74.

With the fluid reservoir connected to the ports, the filler plugs 134 and 138 are tightened down until the lower o-rings thereon are tightly fitted against the walls of the smaller diameter of the respective ports, thereby sealing the ports. The vacuum pump and fluid fill lines are then removed. The outer body part 126 forming the extension sub 92 is then threaded into place on the right hand end of the outer body part 125 and the retaining pin 128 is removed. The extension sub thereby forms a retainer to hold the seal cartridge in place.

Although an examplary embodiment of the invention has been disclosed for purposes of illustration, it will be understood that various changes, modifications and substitutions may be incorporated into such embodiment without departing from the spirit of the invention as defined by the claims appearing hereinafter.

What is claimed is:

1. A well jar comprising:

telescoping inner mandrel and outer body elements;

a connector on each of said telescoping elements;

torque drive between said telescoping elements and adapted to permit relative longitudinal movement therebetween;

an intermediate element rotatably mounted relative to and intermediate to said telescoping elements and affixed longitudinally relative to a first one of said telescoping elements;

a releasable latch connected between said intermediate element and one of said telescoping elements, said releasable latch preventing relative longitudinal movement of said intermediate and telescoping elements and, upon application of at least a predetermined longitudinal force, causing relative rotation between said intermediate and said one telescoping elements to a release position, said intermediate and said one telescoping elements when in said release position allowing longitudinal movement of said telescoping elements;

time delay means connected between the intermediate element and one of said telescoping elements for restraining such relative rotational movement to the release position for a preselected time interval of application of such predetermined longitudinal force; and hammer means comprising coacting impact faces, at least one on each of said telescoping elements, positioned for contact at an end of such longitudinal movement.

2. A well jar according to claim 1 comprising resilient means for angularly urging said intermediate element with respect to said one telescoping element away from said release position and for predetermining said at least a predetermined force.

3. A well jar according to claim 1 wherein said time delay means comprises means for converting rotational movement of the intermediate member into a linear longitudinal movement in the jar and a timer apparatus for substantially restraining said linear longitudinal movement for said preselected time interval.

4. A well jar according to claim 3 wherein said converting means comprises a first part affixed to said intermediate member and a second part which is both mounted on at least one of said telescoping elememts for longitudinal movement in the jar and connected to said timer apparatus, at least one of said first and second parts of the converting means comprising an inclined surface facing in a longitudinal direction in the jar and engaging the other one of such parts.

5. A well jar according to claim 4 wherein said timer apparatus comprises a substantially fluid-tight chamber extending longitudinally of the jar for containing a fluid, a piston slidable longitudinally of the jar in said chamber and providing a substantially fluid isolated chamber portion on each end thereof, a fluid flow regulator providing a fluid flow around said piston from one chamber portion to the other and adapted to allow substantially a constant flow of such fluid with variations in force on the piston transmitted through said converting means.

6. A well jar according to claim 5 comprising a unilateral substantially free flow valve providing a flow of such liquid around said piston from said other chamber portion to said one chamber portion.

7. A well jar according to claim 6 comprising resilient means for urging said piston in a linear direction in said chamber to an initial position.

8. A well jar according to claim 1 wherein said time delay means comprises:

a longitudinally extending substantially fluid-tight chamber for containing a fluid;

a piston slidable in opposite directions in said chamber and substantially isolating such fluid on one end of the piston from the other;

at least one substantially constant fluid flow regulator in said piston positioned to allow such fluid to flow from a first end of the piston to a second end under longitudinal force tending to move the piston; and a torque to linear movement converter connected from the intermediate member to said piston for translating rotational force of the intermediate member to longitudinal linear force on the piston.

9. A well jar according to claim 8 comprising at least one unilateral substantially free flow valve in said piston positioned to allow such fluid to return from said second end to said first end of the piston.

10. A well jar according to claim 9 comprising a resilient coil means acting between at least one of said telescoping elements and an opposite end of said piston from said torque to linear movement converter so as to return said piston to an initial position after applied longitudinal force against the piston is removed.

11. A well jar according to claim 8 comprising means connected between one of said telescoping elements and said piston for restraining relative rotational movement therebetween.

12. A well jar according to claim 11 wherein said restraining means comprises at least one first member affixed to at least one of said telescoping elements and extending in said chamber in a longitudinal direction of the jar toward said piston and a second member affixed to an end of said piston and extending therefrom in the longitudinally opposite direction and in side engagement with said first member.

13. A well jar according to claim 8 wherein said fluid chamber also contains said latch.

14. A well jar according to claim 13 wherein said jar comprises at least first and second fluid filler ports one at an end of said chamber adjacent said piston and one at an end of said chamber adjacent to said latch to allow simultaneous filling of said chamber on opposite sides of said piston.

15. A well jar according to claim 13 wherein said torque drive is positioned toward one end of said jar and said time delay means is positioned in said chamber toward the opposite end of said jar and said latch mechanism is positioned in said chamber and in between the torque drive and piston to allow the jar to be vertically oriented with the interconnecting means and the latch mechanism upwards of the piston so that lighter fractions of such fluid will rise in the chamber and away from said piston.

16. A well jar according to claim 13 comprising a compensating seal positioned at one end of said chamber to thereby allow expansion of the volume of said chamber with expansion of such fluid.

17. A well jar comprising:

telescoping inner mandrel and outer body elements;

a connector on each of said telescoping elements;

a torque drive between said telescoping elements adapted to permit relative longitudinal movement therebetween;

a latch mechanism comprising an intermediate element rotatably mounted relative to and intermediate said telescoping elements and affixed longitudinally relative to a first one of said telescoping elements;

a latch comprising a first part on said intermediate element and a second part on a second one of said telescoping elements, said parts being interengageable to prevent relative longitudinal movement of said intermediate and telescoping elements and upon relative rotation to a breakaway position, disengageable to allow such longitudinal movement, one of said parts comprising an inclined surface which, upon a relative longitudinal force between the telescoping elements, causes relative rotational movement of said intermediate element and said second telescoping element to such breakaway position of said parts;

time delay means connected between the intermediate element and one of said telescoping elements for restraining such relative rotational movement to the breakaway position for a preselected time interval of application of such longitudinal force;

hammer means comprising coacting impact faces, at least one on each of said telescoping elements, positioned for contact at an end of such longitudinal movement; and resilient means for relatively rotating said intermediate element with respect to said telescoping elements to the engaged positions of said parts upon a predetermined longitudinal alignment between said telescoping elements.

18. A well jar according to claim 17 wherein said torque drive comprises a splined connection between the telescoping elements.

19. A well jar according to claim 17 wherein said resilient means applies torque of a magnitude which predetermines a minimum amount of such longitudinal force between said telescoping elements for causing such rotation between said telescoping elements.

20. A well jar according to claim 17 wherein said time delay means comprises a converter of rotational movement of the intermediate element into a linear longitudinal movement in the jar and a timer for substantially restraining said linear longitudinal movement for said preselected time interval.

21. A well jar comprising:

telescoping tubular shaped inner mandrel and outer body elements;

a connector on each of said telescoping elements;

a splined connection between said telescoping elements for transmitting torque therebetween and being adapted to permit relative longitudinal movement therebetween;

a latch mechanism comprising an intermediate tubular shaped element rotatably mounted about said inner telescoping element and positioned in between said telescoping elements and affixed longitudinally to said outer telescoping elements, and a latch comprising a first roller part on said intermediate element and a second cam part on said inner telescoping element, said parts being interengageable to prevent relative longitudinal movement of said telescoping elements and upon relative rotation to a breakaway position, disengageable to allow such longitudinal movement, said cam part comprising facing inclined surfaces which, upon a relative longitudinal force in either direction between the telescoping elements, causes a force between said parts thereby causing relative rotational movement between said intermediate element and said inner telescoping element to such breakaway position of said parts;

hydraulic time delay means connected to the intermediate element for restraining such relative rotational movement to the breakaway position for a preselected time interval of application of such longitudinal force;

hammer means comprising first and second coacting impact faces on said telescoping elements, positioned for contact at an end of such longitudinal movement in either direction; and resilient means for causing relative rotation between said intermediate element and said telescoping elements to the engaged positions of said parts upon a predetermined longitudinal alignment between said telescoping elements.

22. A well jar having telescoping inner and outer elements having a torque transmitter therebetween, an intermediate member which is mounted for rotation relative to said telescoping elements and is affixed in a longitudinal direction to one of said telescoping elements and a releasable latch connected between said intermediate member and one of said telescoping elements, said intermediate member and said telescoping elements being relatively rotatable upon a predetermined minimum longitudinal force applied between said telescoping elements, such rotation causing a release of said latch to allow the longitudinal force to cause movement of the telescoping elements to an impact of coacting impact faces carried with said telescoping elements, the improvement comprising time delay apparatus connected between said intermediate member and at least one of said telescoping elements for restraining such relative rotation for a preselected time interval of application of such minimum longitudinal force.

23. A well jar according to claim 22 wherein said time delay apparatus comprises a rotational to linear converter for converting the rotational movement of the intermediate member into a linear longitudinal movement in the jar and a timer for substantially restraining said linear longitudinal movement for said preselected time interval.

24. A well jar according to claim 23 wherein said converter comprises a first part affixed to said intermediate element and a second part which is both mounted on at least one of said telescoping elements for longitudinal movement in the jar and connected to said timer, at least one of said first and second converter parts comprising an inclined surface facing in a longitudinal direction in the jar and engaging the other one of such parts.

25. A well jar according to claim 24 wherein said timer comprises a substantially fluid-tight chamber extending longitudinally of the jar for containing a fluid, a piston slidable longitudinally of the jar in said chamber and providing a substantially fluid isolated chamber portion on each end thereof, a fluid flow regulator providing a fluid flow around said piston from one chamber portion to the other and adapted to allow substantially a constant flow of such fluid with variations in force on the piston transmitted through said converter.

26. A well jar according to claim 25 comprising a unilateral substantially free flow valve providing a flow of such liquid around such piston from said other chamber portion to said one chamber portion.

27. A well jar according to claim 22 wherein said time delay apparatus comprises:

a longitudinally extending substantially fluid-tight chamber for containing a fluid;

a piston slidable in opposite directions in said chamber and substantially isolating such fluid on one end of the piston form the other;

a substantially constant fluid flow regulator in said piston positioned to allow such fluid to flow from a first end of the piston to a second end under longitudinal force tending to move the piston; and a torque to linear movement converter connected from the intermediate member to said piston for translating rotational force of the intermediate element to longitudinal linear force on the piston.

28. A well jar according to claim 27 comprising a unilateral substantially free flow valve in said piston positioned to allow such fluid to return from said second end to said first end of the piston.

29. A well jar according to claim 28 comprising a resilient means acting in between at least one of said telescoping elements and an opposite end of said piston from said torque to linear movement converter so as to return said piston to an initial position after applied linear force against the piston is removed.

30. A well jar according to claim 27 comprising means connected between one of said telescoping elements and said piston for restraining relative rotational movement therebetween.

31. A well jar according to claim 30 wherein said restraining means comprises at least one first member affixed to one of said telescoping elements and extending in said chamber in a longitudinal direction of the jar toward said piston and a second member affixed to an end of said piston and extending therefrom in the longitudinally opposite direction and in side engagement with said first member.

32. A well jar comprising:

telescoping inner mandrel and outer body elements;

a connector on each of said telescoping elements;

a connection between said telescoping elements for transmitting torque therebetween and being adapted to permit relative longitudinal movement therebetween;

an intermediate element rotatably mounted relative to and intermediate to said telescoping elements and affixed longitudinally relative to a first one of said telescoping elements;

a releasable latch connected between said intermediate element and one of said telescoping elements, said releasable latch preventing relative longitudinal movement of said intermediate and telescoping elements, longitudinal relative movement between said telescoping elements causing said latch to impart relative rotation between said intermediate element and said one telescoping element to a release position wherein the releasable latch permits substantially free longitudinal movement between said telescoping elements;

time delay apparatus connected between the intermediate element and one of said telescoping elements for restraining such relative rotational movement to the release position for a preselected time interval of application of a longitudinal force between the telescoping elements; and a hammer comprising coacting impact faces, at least one carried with each of said telescoping elements, positioned for contact at an end of such longitudinal movement.

33. A combined rotational to linear movement converter and constant fluid control piston part for a well jar comprising:

an elongated tubular shaped element having first and second ends and a diametrically enlarged and elongated circular central piston portion;

a cam at said first end and forming at least a segment of a circle which is coaxial with respect to said piston portion when viewed from said first end and having an inclined cam surface when viewed from a side of such tubular shaped element;

at least one elongated finger member forming a segment of a circle which is coaxial with said piston portion and extends longitudinally from said piston portion;

at least first and second passages extending between the ends of said piston portion;

a constant fluid flow rate regulator positioned in said first passage; and a check valve positioned in said second passage for allowing substantially free flow of such fluid in only one direction.

34. A converter and piston part according to claim 33 comprising a first seal extending around the outer surface of said piston for providing a seal with an inner facing wall of an annular chamber in which such piston is positioned and a second seal extending around the inner surface of said tubular shaped element for providing a seal with an outwardly facing wall of such annular chamber.

35. A converter and piston part according to claim 33 comprising at least two of said cams.

36. A converter and piston part according to claim 33 comprising a plurality of said finger members relatively angularly displaced.

37. A combined rotational to linear movement converter and constant fluid control piston part for a well jar comprising:

an elongated tubular shaped element having first and second ends and a diametrically enlarged and elongated circular central piston portion;

a cam at said first end and forming at least a segment of a circle which is coaxial with respect to said piston portion when viewed from said first end and having an inclined cam surface when viewed from a side of such tubular shaped element;

at least one elongated finger member forming a segment of a circle which is coaxial with said piston portion and extends longitudinally from said piston portion; and at least first and second passages extending between the ends of said piston portion.

* * * * *

UNITED STATES PATENT AND TRADEMARK OFFICE

CERTIFICATE OF CORRECTION

PATENT NO. : 4,023,630

DATED : May 17, 1977

INVENTOR(S) : Gregg S. Perkin et al.

It is certified that error appears in the above-identified patent and that said Letters Patent are hereby corrected as shown below:

Column 2, line 66, to
Column 3, line 1, delete "A releasable latch is connected between the telescoping elements".

Column 5, line 15, "parallel" is misspelled;

Column 11, line 34, insert "together" after "threaded";

Column 17, line 58, "from" is misspelled.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*